United States Patent [19]

Hengtzu

[11] Patent Number: 5,050,627

[45] Date of Patent: Sep. 24, 1991

[54] UMBRELLA FRAME SYSTEM

[76] Inventor: Chuang-Lee Hengtzu, No. 58, Ten Hsin Li, Hsih Pu Chang Hsinchu Shien, Taiwan

[21] Appl. No.: 459,340

[22] Filed: Dec. 29, 1989

[51] Int. Cl.[5] ..... A45B 25/12

[52] U.S. Cl. ..... 135/23; 135/37; 135/38

[58] Field of Search ..... 135/22, 23, 24, 37, 135/38

[56] References Cited

U.S. PATENT DOCUMENTS

| | | | |
|---|---|---|---|
| 636,936 | 11/1899 | Worring | 135/23 |
| 855,142 | 5/1907 | Steininger | 135/23 |
| 923,130 | 6/1909 | Beaudry | 135/22 |
| 1,140,801 | 5/1915 | Cohic | 135/23 |
| 1,247,159 | 11/1917 | Schlesinger | 135/23 |
| 3,732,881 | 5/1973 | Hirai | 135/22 |

FOREIGN PATENT DOCUMENTS

| | | | |
|---|---|---|---|
| 1188774 | 3/1965 | Fed. Rep. of Germany | 135/24 |
| 1934357 | 10/1970 | Fed. Rep. of Germany | 135/22 |
| 1172490 | 2/1959 | France | 135/23 |
| 19644 | of 1859 | United Kingdom | 135/23 |

*Primary Examiner*—Henry E. Raduazo

*Attorney, Agent, or Firm*—Morton J. Rosenberg; David I. Klein

[57] ABSTRACT

This invention relates to a springless umbrella capable of being opened and closed under the elasticity of the ribs, which simplifies the manufactured and assembled process of the shaft and reduces the cost and provides a convenient umbrella for use.

1 Claim, 4 Drawing Sheets

UMBRELLA FRAME SYSTEM

BACKGROUND OF THE INVENTION

This invention relates to an improved umbrella frame for an umbrella which may be easily opened and closed without the use of springs located internal to the shaft of the umbrella.

In the prior art, many known umbrellas have been provided with an upper spring internal the umbrella shaft for securing the umbrella in an open position. The manufacturing process of springs and the assembly thereof are complex and increase the overall manufacturing cost. Known auto-umbrellas which are formed without upper springs have generally been provided with a lower spring for maintaining the umbrella in a closed position. Such prior art causes a similar complexity problem as has been previously described. Additionally, in the latter prior art systems when such are in a closed position, the coil spring of the shaft is in tension. If the umbrella is unused over a prolonged period of time, the elasticity of the coil springs for the shafts are diminished in their force loading capabilities.

SUMMARY OF THE INVENTION

It is the purpose of the present invention to mitigate and/or obviate the above-mentioned drawbacks in the manner set forth in the Description of the Preferred Embodiment.

A primary objective of the present invention is to provide an improved umbrella which is devoid of any spring members inside the shaft of the umbrella and capable of being opened and closed easily under the elasticity of the ribs.

Another objective of the present invention is to provide an umbrella which has a shaft formed in a single mold. Such may simplify the manufacturing process and reduce the overall cost.

Further objects and advantages of the present invention will become apparent as the following description proceeds and the features of novelty which are characterized in the claim annexed hereto and forming a part of this invention.

DETAILED DESCRIPTION OF THE PREFERRED EMBODIMENT

Figure 1:
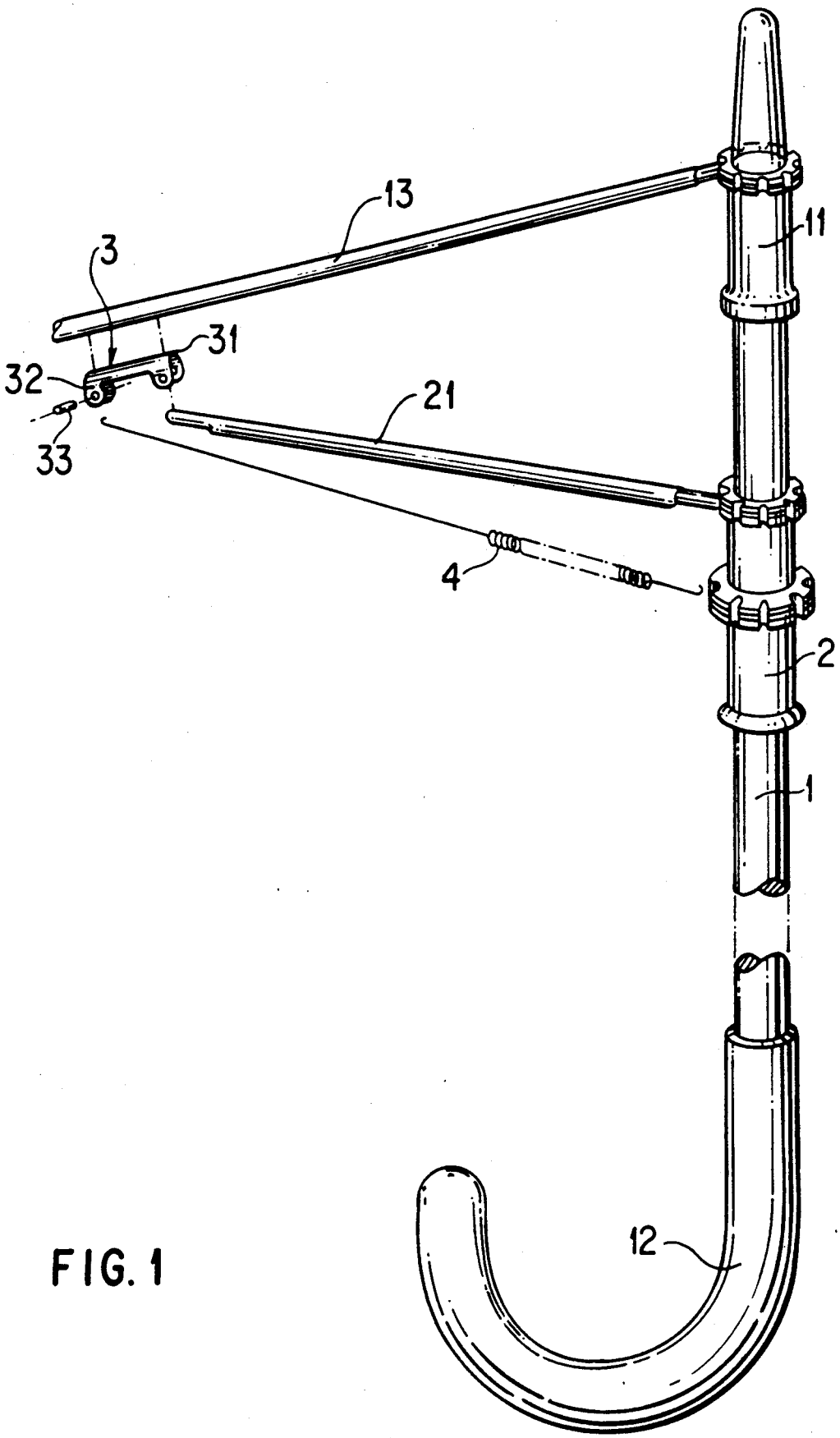
FIG. 1 is a partial perspective view of an umbrella in accordance with the present invention.

Referring to FIG. 1, the shaft member (1) of the present invention is formed in the shape of a cylinder in a one-piece fashion by molding. The shaft has a notch member (11) at an upper end of the shaft member (1). The umbrella includes a handle (12) formed in a lower end of the shaft member (1). A runner (2) is provided in surrounding fashion around the shaft (1) and is free to be displaced upwardly or downwardly on the shaft member (1). A plurality of many rib members (13) having a U-shaped cross-section are provided. The rib members (13) are elastic and are pivotally connected on a first end to the notch member (11). The upper end of the runner (2) is coupled to a plurality of stretcher members (21) corresponding in number and aligned with the main ribs (13). A second end of each of the stretchers (21) is coupled to the inner part (31) of a respective joint member (3) which is engaged with the free or second end of each of the main ribs (13). A pin (33) is provided at the outer part (32) of each joint member (3) for pivotal coupling of a respective stretcher (21).

Figure 2B:
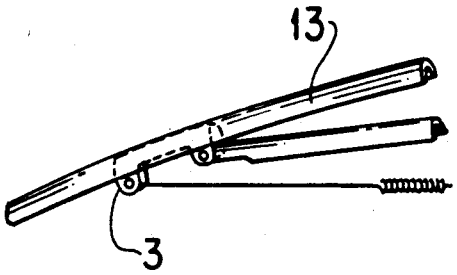
FIG. 2 is an elevational view illustrating the umbrella frame according to the present invention.
Figure 2A:
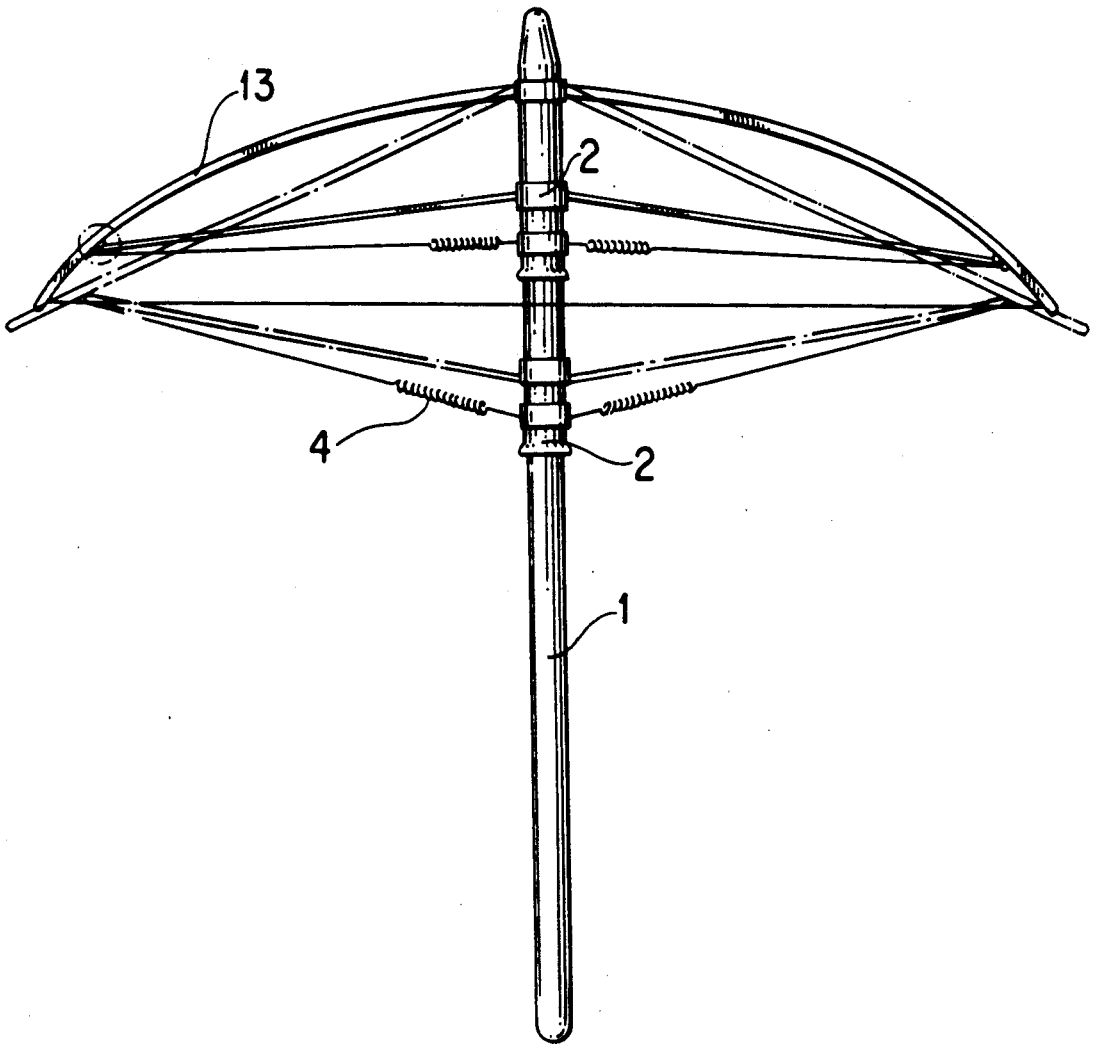

As shown in FIG. 2, the stretchers (21) and the coil spring members (4) are coupled respectively to inner portion (31) and outer portion (32) of joint member (3) to provide a distribution of forces on the ribs (13). A coil spring (4) is provided in each stretcher (3) which has one end connected with the respective pin (33) and the other end with the middle portion of the runner member (2).

Figure 3:
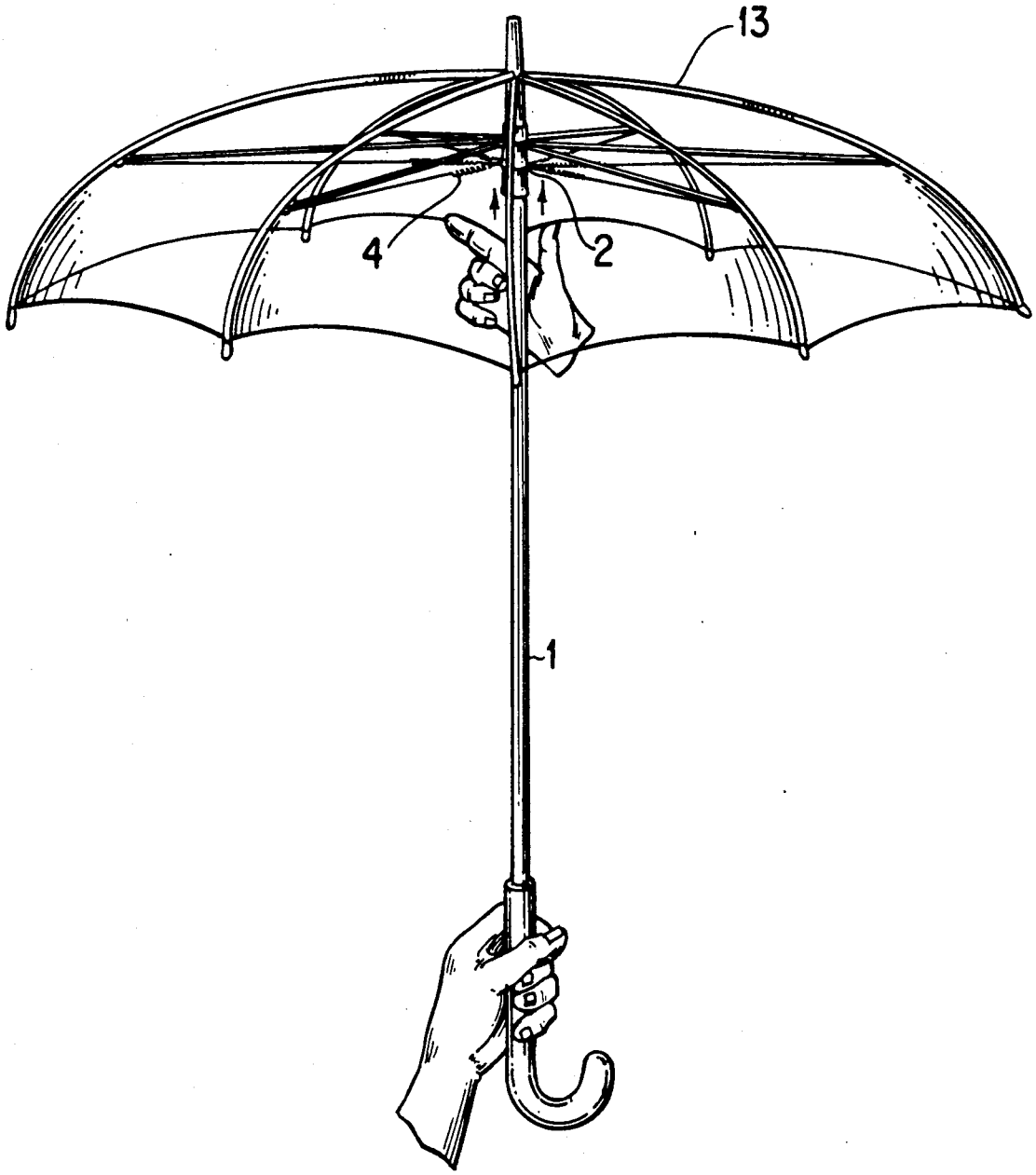
FIG. 3 is a perspective explanatory view of the umbrella frame shown in the opened position.
Figure 4:
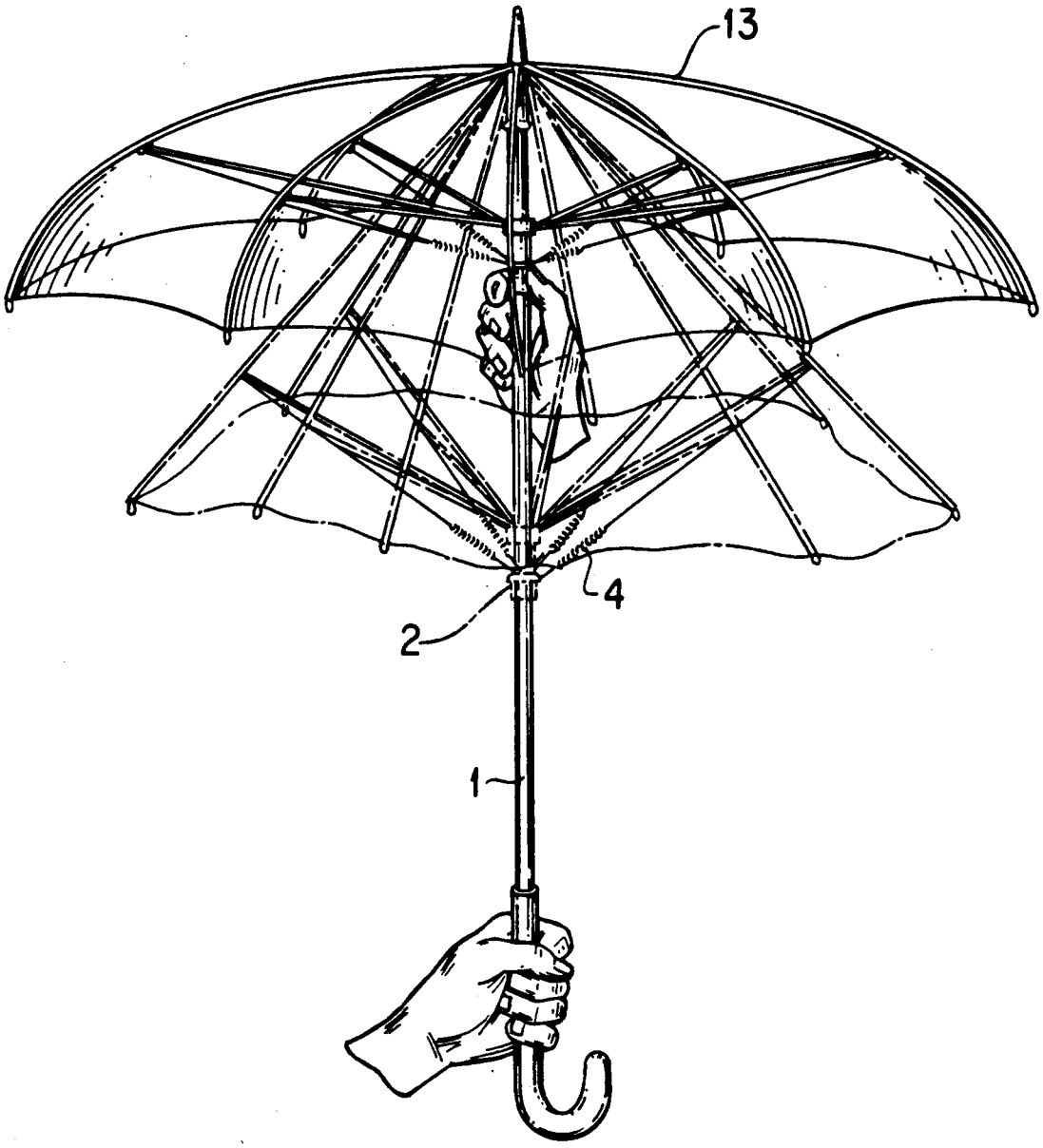
FIG. 4 is a perspective explanatory view of the umbrella frame with the umbrella in a closed position.

As shown in FIG. 2, the main rib members (13) of the present invention are elastic or resilient in nature. As the runner (2) is displaced upwardly for opening the umbrella, the ribs (13) are arcuately deformed. The maximum tension is found when the stretcher member (21) is perpendicular to the shaft member (1). Due to this perpendicular force, the frame is stabilized. When the user displaces the runner (2) upwardly or downwardly, the recovered force of the ribs (13) open the umbrella as shown in FIG. 3 or close the umbrella as shown in FIG. 4. Additionally, the coil springs (4) provide a recovery force for closing the umbrella while maintaining a distributive load of the rib members (13). The coil spring tension force is released when the umbrella is closed wherein the coil spring members (4) are not damaged during a period of umbrella storage in the closed position. When the umbrella is opened, the coil springs (4) are elongated and a recovery force is produced which facilitates closing the umbrella.

As various possible embodiments may be made of the above-mentioned without departing from the scope of the invention, it is to be understood that all matter herein described or shown in the accompanying drawings is to be interpreted as illustrative and not in a limiting sense. Thus, it will be appreciated that the drawings are exemplary of a preferred embodiment of the invention.

I claim:

1. An umbrella frame system for an umbrella having a one-piece molded shaft extending in a longitudinal direction and a notch member fixedly secured to an upper end of said shaft, said umbrella frame system including a runner member slideably received on said shaft responsive to opening and closing of the umbrella, comprising:

(a) a plurality of elastic cross-sectional U-shaped main rib members, each of said main rib members being pivotally coupled to said notch member on a first end of each of said main rib members;

(b) a plurality of elongated stretcher members, each of said stretcher members pivotally coupled to said runner member on a first end of each of said stretcher members;

(c) a plurality of inverted U-shaped joint members secured to a second end of each of said main rib members and a second end of each of said stretcher members, said stretcher members being pivotally connected to said joint member; and, (d) a plurality of coiled spring members coupled on opposing ends between said joint members and said runner member, whereby said coiled spring members are tensioned when said umbrella is opened and are released of tensioning forces when said umbrella is closed, said inverted U-shaped joint members being coupled to respective stretcher and coiled spring members on opposing ends thereof distributing the force load on respective main rib members.

* * * * *